US009102031B2

(12) United States Patent
Page

(10) Patent No.: US 9,102,031 B2
(45) Date of Patent: Aug. 11, 2015

(54) APPARATUS FOR SHARPENING BLADES

(71) Applicant: James Herbert Page, Acampo, CA (US)

(72) Inventor: James Herbert Page, Acampo, CA (US)

( * ) Notice: Subject to any disclaimer, the term of this patent is extended or adjusted under 35 U.S.C. 154(b) by 49 days.

(21) Appl. No.: 13/967,585

(22) Filed: Aug. 15, 2013

(65) Prior Publication Data

US 2014/0213160 A1 Jul. 31, 2014

Related U.S. Application Data

(60) Provisional application No. 61/849,653, filed on Jan. 30, 2013.

(51) Int. Cl.

| | |
|---|---|
| ***B24B 3/36*** | (2006.01) |
| ***B24B 27/00*** | (2006.01) |
| ***B24B 23/00*** | (2006.01) |

(52) U.S. Cl.

CPC ..... *B24B 3/365* (2013.01); *B24B 23/005* (2013.01); *B24B 27/0015* (2013.01); *B24B 27/0084* (2013.01); *B24B 27/0038* (2013.01)

(58) Field of Classification Search

CPC ..... B24B 3/36; B24B 3/365; B24B 27/0015; B24B 27/0038; B24B 27/0084; B24B 23/005

USPC ..... 76/82.1; 269/59, 60; 451/45, 48, 344, 451/361, 367, 369, 234, 371

See application file for complete search history.

(56) References Cited

U.S. PATENT DOCUMENTS

| | | | | |
|---|---|---|---|---|
| 135,456 | A * | 2/1873 | Walters | 451/280 |
| 2,547,057 | A * | 4/1951 | Stieglitz | 451/359 |
| 3,888,049 | A * | 6/1975 | MacSween | 451/158 |
| 4,736,544 | A | 4/1988 | Greenquist | |
| 5,218,787 | A | 6/1993 | Rice | |
| 6,471,569 | B1 | 10/2002 | Bernhard | |
| 6,761,623 | B1 | 7/2004 | Baker | |
| 6,786,806 | B2 | 9/2004 | Maus, Jr. | |
| 7,329,172 | B2 | 2/2008 | Dieck et al. | |
| 7,918,715 | B2 | 4/2011 | Clark et al. | |
| 7,967,666 | B1 | 6/2011 | Messner | |
| 2008/0188164 | A1 * | 8/2008 | Droese | 451/45 |
| 2012/0322349 | A1 * | 12/2012 | Josi | 451/73 |

* cited by examiner

*Primary Examiner* — Timothy V Eley
(74) *Attorney, Agent, or Firm* — R. Michael West

(57) ABSTRACT

An apparatus for sharpening blades, such as those used for mowing. A rotary grinder is mounted within an extensible, retractable, and rotatable support assembly. Lockable, rotational adjustment of the position of the grinder about three axes, and translational movement along one axis is thereby provided. A spring attached to one end of the assembly counter-balances the weight of the grinder. An adjacent blade holding fixture maintains the workpiece at a predetermined angle for grinding. A toggle clamp, edge alignment keepers, and a registration pin secure the blade in place. An adapter fixture, including a toggle clamp and an alignment recess, attaches to one end of the blade holding fixture. The adapter fixture has an angled shelf to orient and secure smaller, contoured blades requiring a different edge grinding angle. Once the support assembly is adjustably secured, the grinder is moved along the cutting edge of the blade for sharpening.

20 Claims, 6 Drawing Sheets

APPARATUS FOR SHARPENING BLADES

PRIORITY CLAIM

Pursuant to the provisions of 35 U.S.C. §119(e)(1), Applicant claims the priority of U.S. Provisional Patent Application Ser. No. 61/849,653, filed Jan. 30, 2013.

BACKGROUND OF THE INVENTION

1. Field of the Invention

The invention relates generally to improvements in devices for sharpening blades that are used for cutting grass, sod, or other plant matter. More particularly, the invention pertains to an apparatus incorporating an extensible, retractable, and rotationally adjustable multi-axis support assembly for a rotary grinder, and a blade holding fixture that maintains the workpiece at a predetermined angle for grinding.

2. Description Of the Prior Art

The prior art includes a number of approaches directed toward the task of sharpening mower blades. For example, U.S. Pat. No. 7,918,715, issued to Clark et al., discloses a Device And Method For Sharpening Blades. A fixture in the '715 Patent, holds the blade to be sharpened in the desired position. An elevated horizontal shaft is slidably coupled by a handle bar whose end adjustably supports a rotary grinder.

In U.S. Pat. No. 6,761,623, granted to Baker, an Apparatus And Method For Sharpening Blades At A Predetermined Angle, are disclosed. Included in Baker's apparatus are a blade retention and positioning mechanism, a blade sharpening mechanism, and a guide rod for directing the blade sharpening mechanism laterally across the width of the apparatus.

Yet another Blade Sharpener employing a rotary grinder is shown in U.S. Pat. No. 7,967,666, issued to Messner. Messner's sharpener employs a blade support, a sharpener guide mounted to the blade support, and a sharpener mount. A rotary grinder is mounted on the end of the sharpener mount, so that the sharpener mount and the grinder may pivot about a sharpening axis to provide the desired sharpening angle on the blade, while allowing translational movement along the sharpening axis for sharpening the full extent of the cutting edge of the blade.

And, in U.S. Pat. No. 7,329,172, issued to Dieck et al., a Rotary Mower Blade Sharpener Having Movable Grinding Wheels is illustrated. The mower blade is mounted on a base plate. Grinding head assemblies are mounted on carriages slidably mounted on a respective rail. The rails are parallel to each other, and located on either side of the blade. The carriages are driven by an endless chain that moves them and the grinding assemblies in unison, so that the two opposing cutting edges of the blade can be simultaneously sharpened.

Another approach to sharpening mower blades is to maintain the grinding apparatus stationary, and then move the cutting edge of the mower blade into and out of engagement with the abrasive wheel of the grinding apparatus. Representative of this approach is the device shown in U.S. Pat. No. 6,786,806, granted to Maus, Jr. The '806 Patent discloses a Rotary Mower Blade Sharpener using a conventional bench grinder in combination with a mower blade holder. As shown in FIGS. 1 and 2, the subject blade is slid into and out of engagement with the grinder's wheel.

Similarly, in U.S. Pat. No. 6,471,569, granted to Bernhard, a Rotary Mower Blade Grinder includes an adjustable support for receiving a rotary mower blade. The position of the blade is movable and adjustable, axially and transversely, to engage a grinding wheel 4.

U.S. Pat. No. 4,736,544, issued to Greenquist, teaches a Blade Holder For Sharpening Lawnmower Blades. Grinder 52 is fixed in position, and the blade support plate 12 is movable, as explained in column 4, lines 5-9 of this reference.

An Apparatus For Sharpening Implements is disclosed in U.S. Pat. No. 5,218,787, granted to Rice. A conventional grinder 12 is mounted on a support post 34. The apparatus has a movable carriage for holding the blade by means of a clamping wrench, so the blade can selectively be moved into engagement with a grinding wheel 22.

Issues regarding the performance of prior art blade sharpening devices include inadequate means for precisely adjusting and maintaining the angle of the grinding wheel during the grinding process. Known prior art blade sharpening devices also lack features for securely maintaining the subject blade at a selected predetermined angle, so the cutting edge can be faithfully restored to manufactured specifications. And, such prior art devices do not include simple and reliable means for positioning, locking, and releasing blades in a blade holding fixture, specifically designed for sharpening a blade having either two opposing cutting edges, or a blade having a single edge with a complex cutting edge contour.

Therefore, it is an object of the apparatus disclosed herein to sharpen blades used for mowing, having different angles and contours for their cutting edges.

It is a further object herein, to mount and utilize a conventional rotary grinder within a rotatable, extensible, and retractable support assembly.

It is also an object herein to support a rotary grinder adjustably about three axes and along one axis for extension and retraction.

It is also an object herein detachably to position and secure a mower blade at a number of different predetermined angles, for sharpening the cutting edge properly.

These and other objects will become apparent in the specification and the detailed description of the preferred embodiment, to follow.

SUMMARY OF THE INVENTION

The apparatus herein is useful for sharpening blades, such as those used for mowing grass or cutting other plant material. A frame or base, generally horizontal to the ground, is maintained at a convenient work height by downwardly extending legs. The frame or base may also be mounted on a workbench, to provide identical utility in a more permanent setting.

A grinder support assembly includes a support member having a lower end attached to the frame, and extending upwardly therefrom. The grinder support assembly also includes a three-way pivot, having a fixed portion mounted to the upper end of the support member. The three-way pivot allows rotation and adjustment of the position of its movable portion, about a generally horizontal first axis, second axis perpendicular to the first axis, and third axis perpendicular to the second axis. The three-way pivot also includes means for selectively locking its movable portion to the extent and manner necessary to undertake a grinding operation.

The grinder support assembly also includes an elongated grinder support arm. The grinder support arm has a first end mounted to the movable portion of the three-way pivot. A grinder mount is secured to a second end of the grinder support arm, remote from the three-way pivot. The grinder support arm is extensible and retractable along its axis, providing for movement of the grinder mount, relative to the cutting edge of a blade to be sharpened.

A conventional hand grinder, having a rotatable grinding disk, is detachably secured within the grinder mount. The hand grinder may easily be removed from the grinder mount for servicing, or for use in another application. A dedicated grinder may also be used in lieu of the removable hand grinder.

The apparatus herein also includes a blade holding fixture, for securing the blade during the grinding process, at a selected predetermined angle. The blade holding fixture includes an inclined plate supported by a post mounted on the frame. The plate may include a registration pin, to assist in the alignment and positioning of a blade having a central hole, such as a lawn mower blade. The plate also includes means for detachably securing the blade over the plate, such as toggle clamps. After one cutting edge of a lawn mower blade is sharpened, the blade is released from the blade holding fixture, flipped around end for end, and secured in place, so the other cutting edge can be sharpened.

An adapter fixture is also provided, for securing smaller blades having only one cutting edge to be sharpened. Such blades may also have a complex contour to the cutting edge, resembling a ramp or curve in a portion of the cutting edge. The adapter fixture includes a toggle clamp and edge alignment keepers to secure the blade. The adapter fixture may conveniently be attached to one end of the blade holding fixture, and its shelf may also be angled so that blades requiring a different edge grinding angle than a conventional blade, may be sharpened.

DETAILED DESCRIPTION OF THE PREFERRED EMBODIMENT

Figure 1:
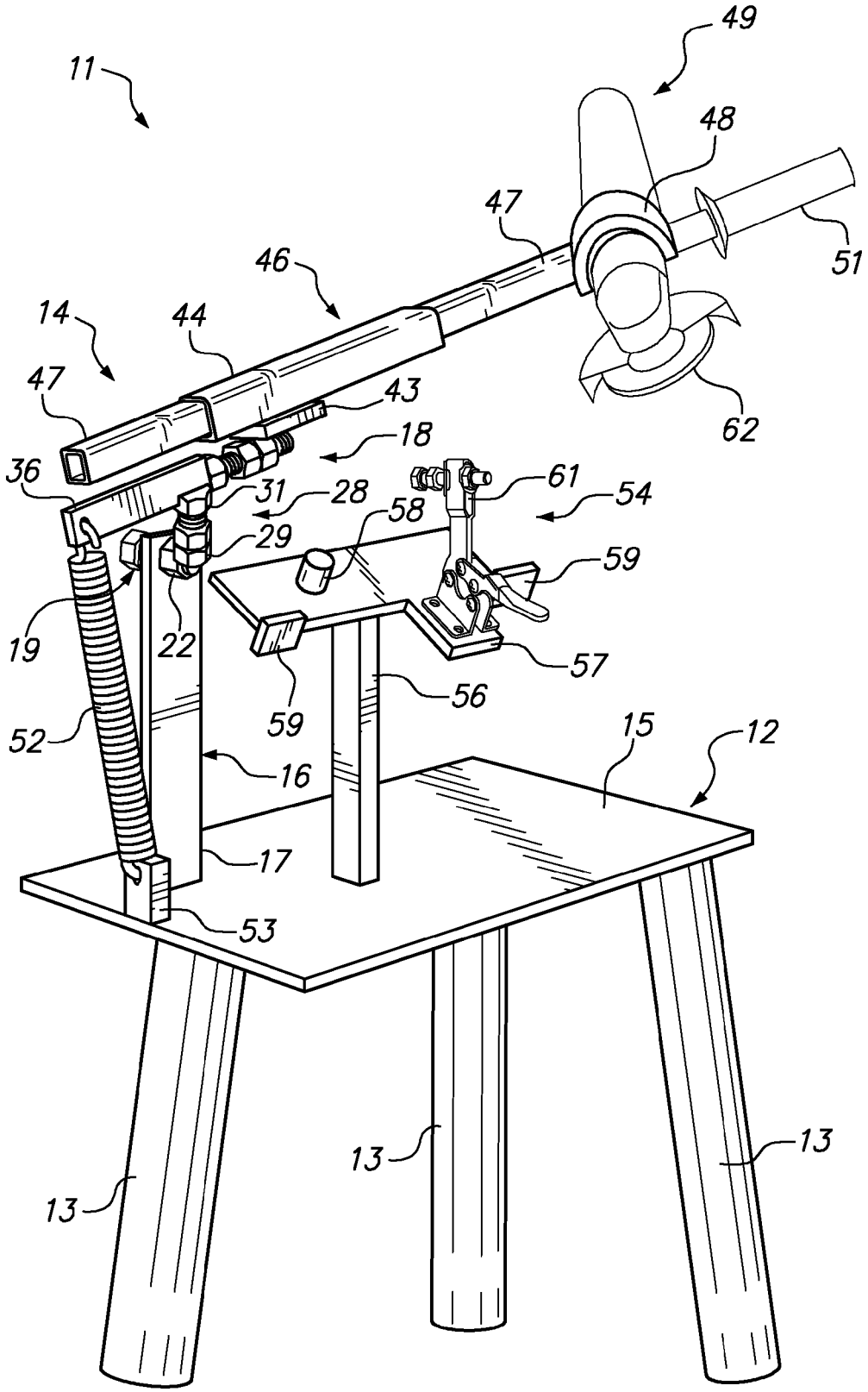
FIG. 1 is a perspective view of the grinding apparatus of the present invention.

Turning now to the drawings, and in particular, to FIG. 1, the apparatus 11 for sharpening blades is disclosed. The apparatus 11 includes a frame 12, preferably in the form of a plate. The frame 12 may include a plurality of legs 13, to maintain the frame 12 in spaced relation from the ground or floor at a convenient working height. Alternatively, legs 13 may be eliminated entirely if it is desired to mount frame 12 directly upon a workbench, or other work surface. It should also be noted that before any grinding operations are undertaken, it is generally advisable to level frame 12 to enhance the ease and accuracy of using the apparatus 11.

The apparatus 11 further includes a grinder support assembly 14, shown in its entirety in FIG. 1. Grinder support assembly 14 includes a vertically extending support member 16 having a lower end 17 attached to the upper surface 15 of frame 12.

Support assembly 14 also includes a three-way pivot 18, having a fixed portion 19 mounted to an upper end 21 of support member 16. A bolt 22 passes through an aperture in upper end 21, and is secured on the rear side of member 16 by fixed portion 19, including a rear nut 23 and a locking nut 24. The threaded shaft 26 of bolt 22, passes through and is threadably engaged by nuts 23 and 24, defining a first horizontal axis 27 of rotation for the pivot 18.

Being capable of rotation about its axis 27, bolt 22 is the first element of movable portion 28 of three-way pivot 18. Rear nut 23 may be adjusted for tightness against upper end 21, providing the desired amount of resistance to rotation of bolt 22 about axis 27. Locking nut 24 may be tightened against nut 23, when a fixed rotational position for bolt 22 is desired. Locking nut 24 will also keep nut 23 from loosening under vibration.

One flat on the side of a transition nut 29 is welded to the head of bolt 22. A transition bolt 31 has a threaded transition shaft 32 which threadably engages a transition nut 29. Threaded transition shaft 32 defines a second axis 33 of rotation, which is perpendicular to first axis 27. A locking nut 34 is also provided on transition shaft 32, so that when shaft 32 is in the desired rotational position, nut 34 may be tightened against nut 29, locking shaft 32 in that position.

Figure 8:
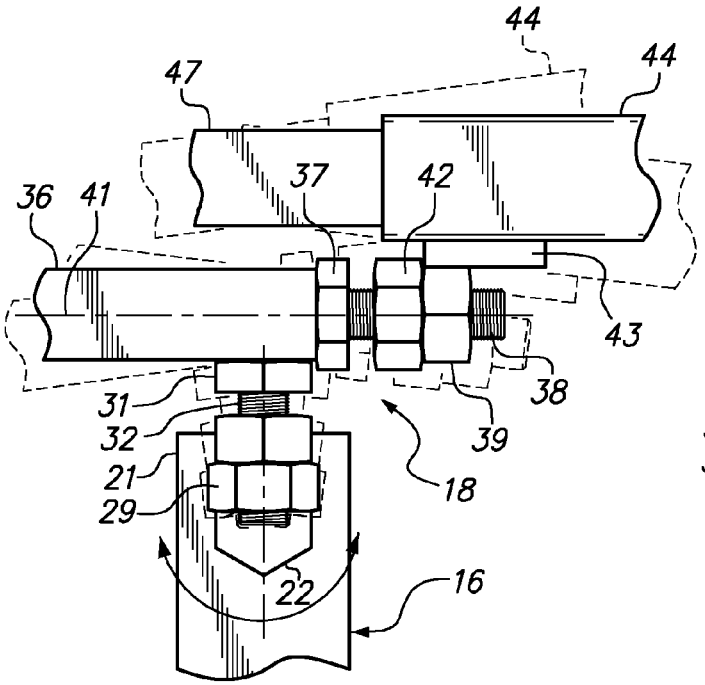
FIG. 8 is a fragmentary side elevational view of the rear side of three-axis pivot, showing rotational adjustment of the grinder support arm about the first axis.
Figure 9:
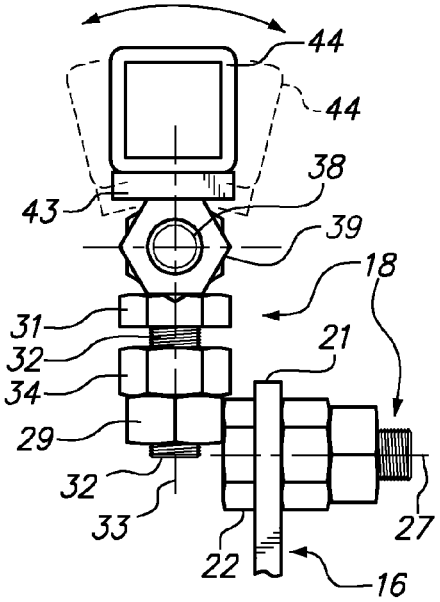
FIG. 9 is a fragmentary end elevational view of the three-axis pivot, showing rotational adjustment of the grinder support arm about the third axis.
Figure 10:
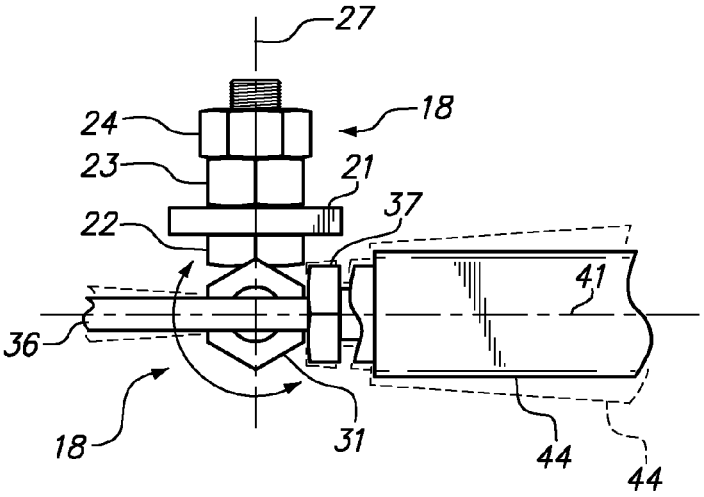
FIG. 10 is a fragmentary top plan view of the three-axis pivot, showing rotational adjustment of the grinder support arm about the second axis.

The next element of movable portion 28 is a bar member 36, preferably oriented on edge for maximum resistance to bending. An edge of one end of bar 36 is welded to the head of transition bolt 31, as shown most clearly in FIGS. 8 and 10. The head of a bar bolt 37 is welded to the same end of bar member 36, adjacent transition bolt 31. Bar bolt 37 includes a threaded bar shaft 38, which threadably engages a bar nut 39. Threaded bar shaft 38 defines a third axis 41 of rotation, which is perpendicular to second axis 33. A locking nut 42 is also provided on bar shaft 38, so that when shaft 38 is in the desired rotational position, nut 42 may be tightened against nut 39, locking shaft 38 in that position.

The lower side of a connection plate 43 is welded to an upper flat on bar nut 39. A first segment 44 of elongated grinder support arm 46, is welded to the upper side of connection plate 43. Connection plate 43 is the last of the elements comprising the movable portion 28 of three-way pivot 18.

It should be apparent to one of ordinary skill in the art that the three-way pivot arrangement just described, can be accomplished in a number of ways without departing from the advantages provided by the disclosed structures. By way of example only, hinged systems, ball and socket combinations, and block and journal bearing constructions could all accomplish the same result with equivalent structures having the same relational features.

As shown in FIG. 1, first segment 44 is located at a first, or proximate end of grinder support arm 46. Grinder support arm 46 also has a second, or distal end, at the far terminus of a second segment 47. Preferably, segments 44 and 47 of support arm 46 are in telescoping relation, so that adjustments in the effective length of arm 46 and the resultant position of the second end may readily be made. In other words, segment 47 may be telescopically extended or retracted with respect to segment 44.

Positioned on the second end of grinder support arm 46, attached to second segment 47, is a grinder mount 48. Grinder mount 48 may comprise a hinged collar, strap, or other clamp arrangement, adapted to secure a conventional hand held grinder 49 in place on the remote end of arm 46. Grinder mount 48 is preferably designed to allow the quick installation and removal of grinder 49, so it can be serviced or used for another purpose. It is also apparent that a grinder solely dedicated, and essentially permanently mounted on the end of grinder support arm 46, will also prove advantageous for some applications. Grinder 49 will typically include an integral handle 51, which is useful for positioning and for manipulating the movement of the grinder 49, for the purposes of the apparatus 11 herein.

Figure 2:
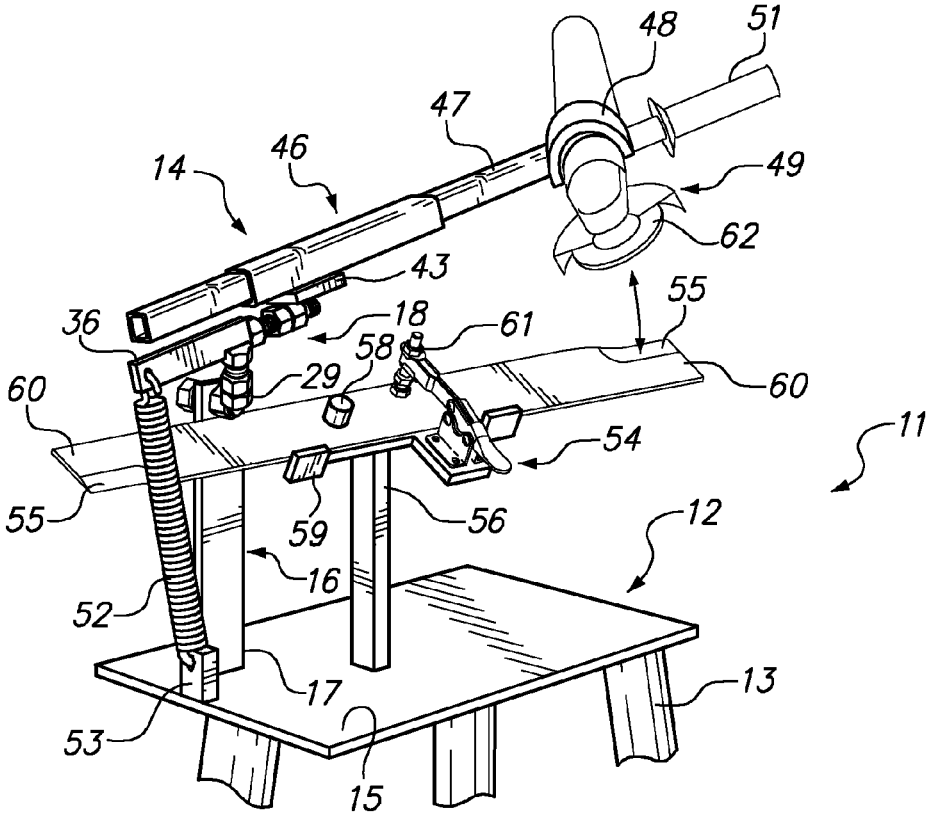
FIG. 2 is a perspective view of the grinding apparatus with a typical rotary lawn mower blade secured in place on the blade holding fixture.
Figure 3:
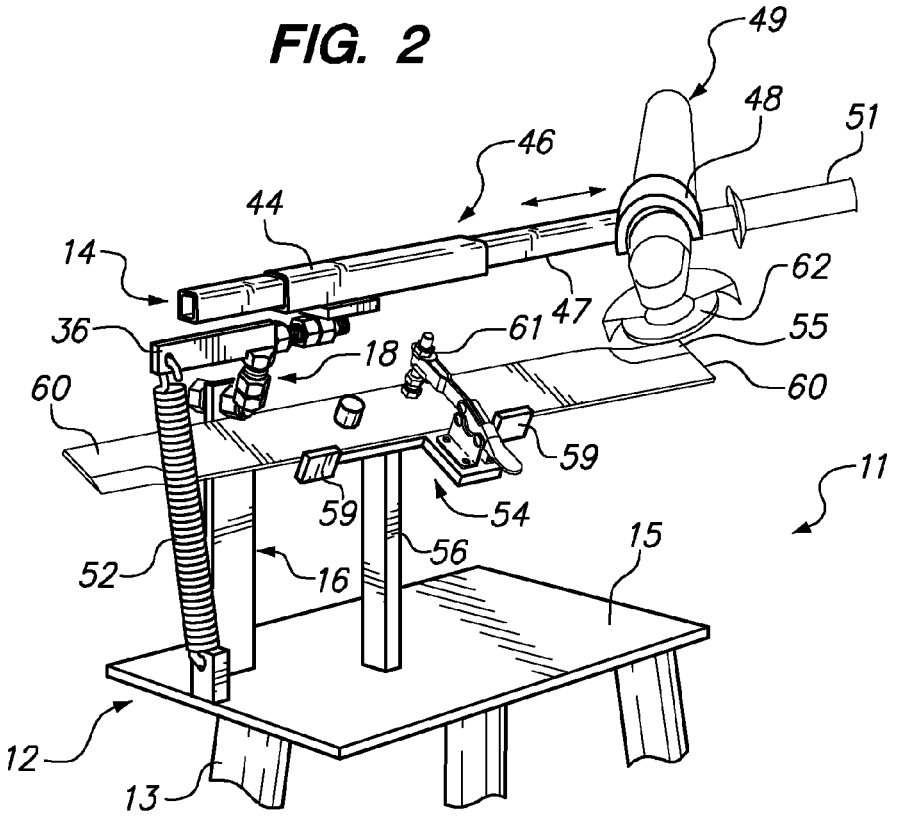
FIG. 3 is a perspective view as in FIG. 2, showing the grinder in position for engaging the blade and resurfacing the cutting edge through extension and retraction of the grinder support arm.
Figure 4:
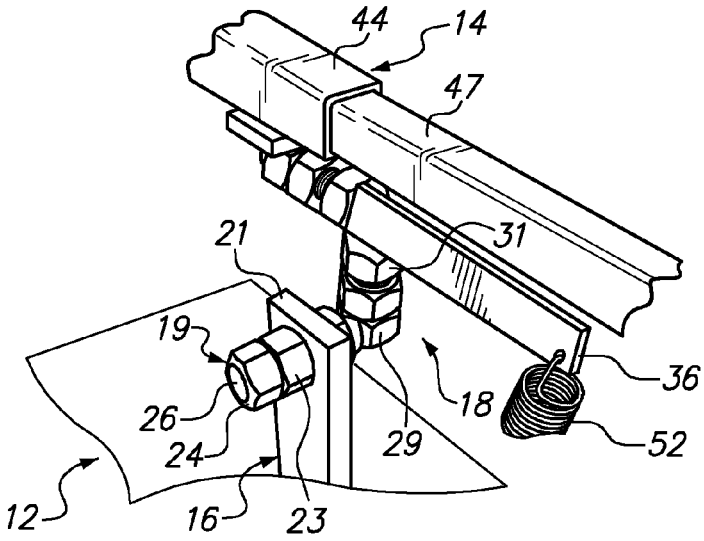
FIG. 4 is a close-up perspective of the front side of the three-axis pivot of the grinder support assembly.
Figure 5:
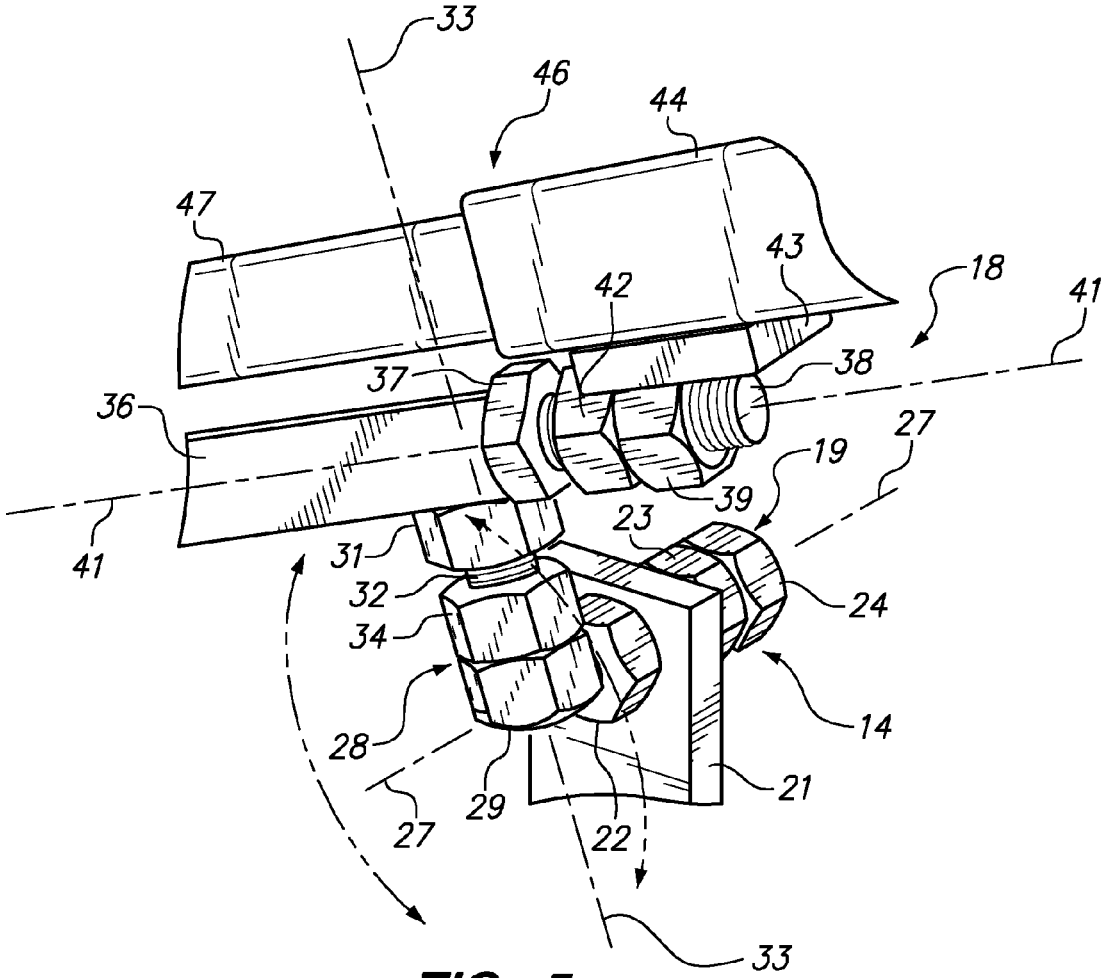
FIG. 5 is a close-up perspective of the rear side of the three-axis pivot, showing rotational adjustment of the grinder support arm about a generally horizontal, first axis.
Figure 6:
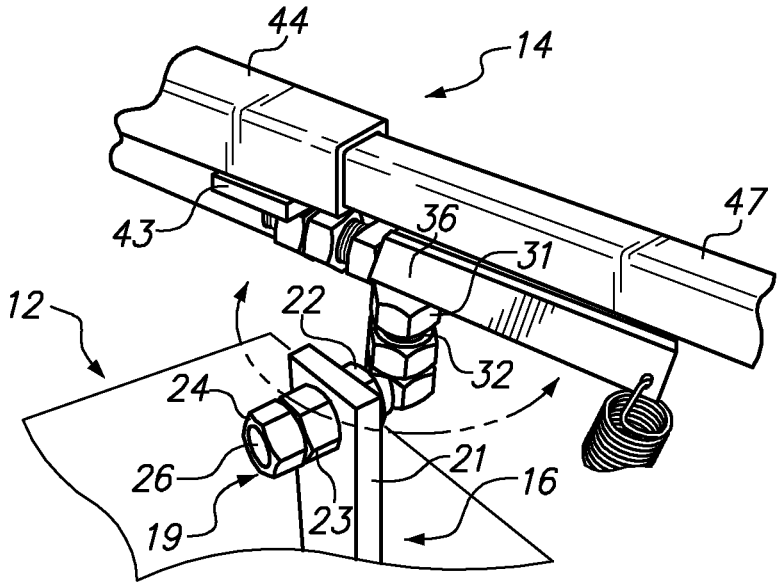
FIG. 6 is a view as in FIG. 4, showing rotational adjustment of the grinder support arm about a second axis, perpendicular to the first axis.
Figure 7:
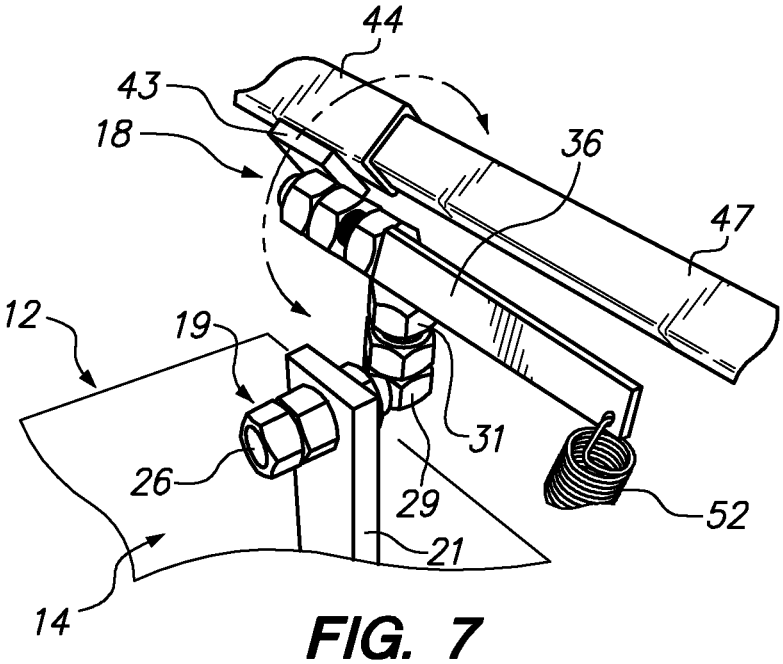
FIG. 7 is a view as in FIG. 4, showing rotational adjustment of the grinder support arm about a third axis, perpendicular to the second axis.

For the purpose of counter-balancing the weight of the grinder 49 mounted on the remote end of the grinder support arm 46, bias means is applied to other end of bar 36. Bias means is readily accomplished by interposing a spring 52 between bar 36 and a connection block 53, mounted on the upper surface 15 of frame 12. FIGS. 2 and 3 illustrate that as grinder 49 is moved downwardly, spring 52 stretches slightly, providing downward bias forces on the other end of bar 36, tending to restore the original position of the grinder support arm 46. This also makes preliminary adjustments and handling of the grinder during a grinding operation much easier than it would otherwise be.

The apparatus 11 also includes a blade holding fixture 54, supported in spaced relation above frame 12 by a post 56. Blade holding fixture 54 includes an inclined plate 57 mounted on the upper end of post 56. Plate 57 is preferably inclined at approximately the same slant, or angle, as the cutting edge of the blade to be sharpened. This inclination is selected so that when a blade is mounted on the blade holding fixture, the cutting edge 55 of the blade 60 will generally be horizontal for the grinding operation. This facilitates ease and accuracy in the grinding operation.

The angles of the cutting edges of a typical rotary mower blades may vary to some extent, but generally, they fall within in the range of 25° to 40°, with 30° being a popular and common angle. It is apparent that the connection between the upper end of post 56 and the underside of plate 57 may be a weld, holding the plate 57 at a fixed, standard inclination. Alternatively, an adjustable connection may be provided through a hinge or another rotatable arrangement so that blades having cutting edges of different angles may be accommodated by the apparatus 11.

For alignment with and attachment to a drive shaft, rotary lawn mower blades typically include a centrally positioned shaft aperture. To utilize that aperture advantageously, inclined plate 57 includes a registration pin 58 extending upwardly from the blade supporting surface. The registration pin 58 is sized and configured to provide a snug fit within the blade's shaft aperture. Inclined plate 57 also includes at least one upwardly extending edge alignment stop 59, located along a lower edge of plate 57. Alignment stops 59 are effective to assist in the placement of a blade 60 on inclined plate 57, as illustrated in FIGS. 2 and 3.

Inclined plate 57 plate also includes means for detachably securing the blade 60 over the blade supporting surface of the plate. For that purpose, at least one toggle clamp 61 is mounted on plate 57. FIG. 1 shows toggle clamp 61 in a raised position, in preparation for the installation of a blade 60 onto inclined plate 57. FIGS. 2 and 3 show toggle clamp 61 in a lowered, clamping position, after blade 60 has been installed.

After blade 60 has been clamped into place on plate 57, the adjustment and locking features of the three-way pivot 18 are utilized to place grinding wheel 62 of the grinder 49 in the proper location and at the proper inclination, so that accurate grinding of the cutting edge 55 can take place. After handle 51 is grasped by the user, grinder 49 is actuated and the wheel 62 is moved along the surface and contour of the cutting edge 55 to restore its sharpness and surface. Depending upon the nature of the cutting surface 55, movement of the grinder 49 inwardly or outwardly, through the feature of the telescoping grinder support arm 46, is made possible. See. FIG. 3. Also, a user of the apparatus 11 may prefer one direction of movement of the grinder 49, through relative extension or retraction of the support arm 46, to be more comfortable or easier to control. After a pass across a cutting edge 55 is made, the direction of movement of the grinder 49 may be reversed, or the grinder 49 may be lifted so that another pass along the same direction may be made.

With one cutting edge 55 on one end of the blade 60 sharpened, the blade 60 is flipped end for end, so the cutting edge 55 on the other end can be sharpened. In that process, the toggle clamp 61 is released, and the blade 60 is flipped around, repositioned on the inclined plate 57, and re-clamped in place by clamp 61. Then, grinding of the other cutting edge 55 can be undertaken, as just described.

Figure 11:
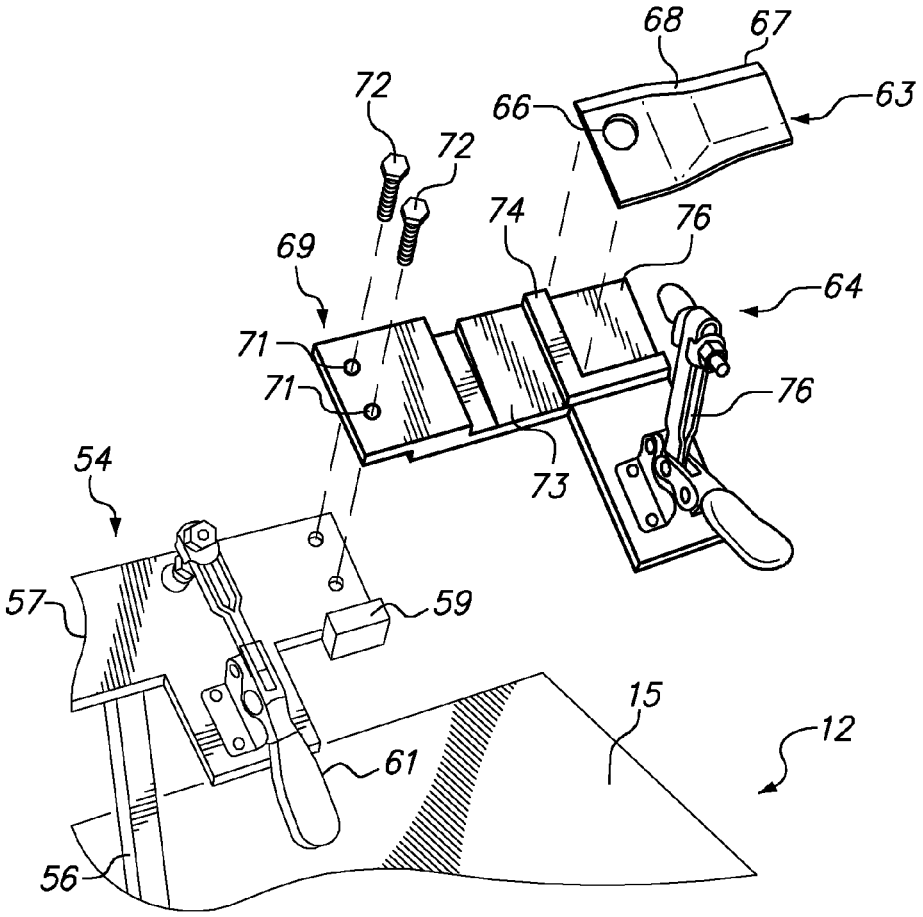
FIG. 11 is an exploded, fragmentary perspective view of the blade holding fixture, the adapter fixture, and the single cutting edge blade with a complex contour; and, FIG. 12 is a fragmentary perspective view of the adapter fixture holding the single edge blade, mounted on one end of the blade holding fixture.
Figure 12:
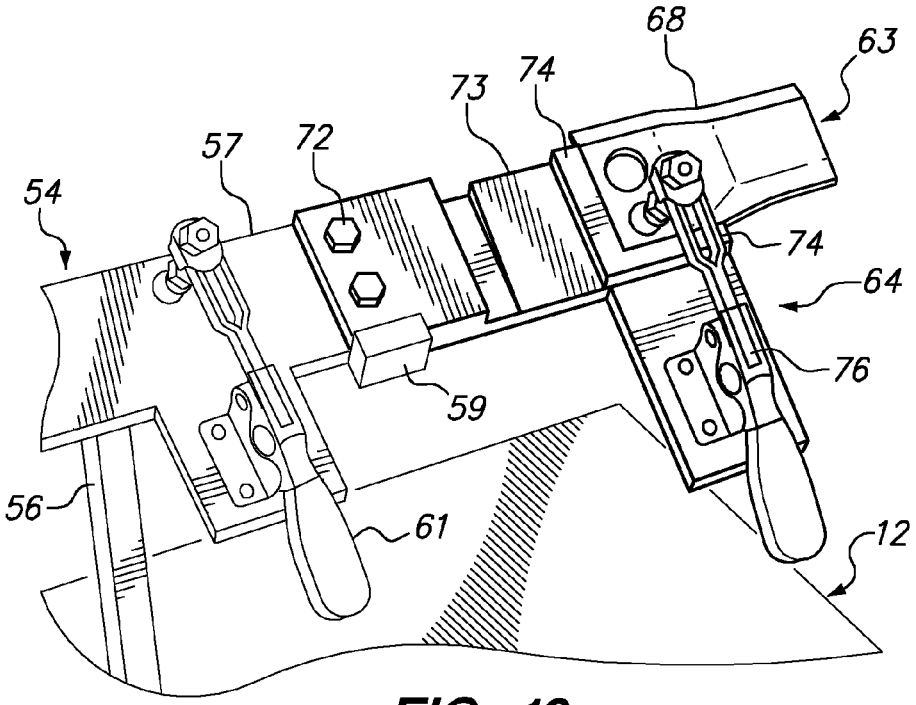

There are other mower blades that differ in size and configuration from the typical rotary lawn mower blade 60, described above. For example, certain mowers used at golf courses and elsewhere where extremely low and accurate cutting is required, use a plurality of short blades having a single, but complex cutting edge, instead of a single blade having cutting edges at both ends. FIGS. 11 and 12 show such a short mower blade 63, and the special adapter fixture 64 designed to accommodate its features.

Blade 63 includes an attachment bore 66 and a complex, contoured cutting edge 67. It should be noted that cutting edge 67 includes a ramp-like inflection 68, approximately midway along its length. It is this inflection 68, that makes sharpening blade 63 so difficult, because the surface of the cutting edge 67 effectively rises when passing from right to left. The current practice known to Applicant, is simply to discard such blades 63, after they become dull. However, through the use of adapter fixture 64, blades 63 can successfully be re-sharpened, providing even greater utility to the apparatus 11.

Adapter fixture 64 includes a blade support plate 69, which has several features worth noting. One end of plate 69 includes holes 71, so that bolts 72 can pass through the holes and be threadably attached to an end of inclined plate 57. These bolts, including edge alignment stop 59, maintain the adapter fixture 64 securely in place with proper alignment. The other end of plate 69 includes a wedge plate 73, which effectively adds another 3 to 5 degrees of inclination to the other end of plate 69. This is done because the angle of the cutting edge 67 of blade 63, is 3 to 5 degrees or so, greater than that of the cutting edge of the standard rotary mower blade. Secured over the wedge plate 73 is an alignment keeper 74. The placement and configuration of alignment keeper 74 defines a recess 76 having a 90° corner to accommodate and maintain the alignment registration of blade 63.

Adapter fixture 64 also includes a toggle clamp 76 which operates in exactly the same fashion as the previously described toggle clamp 61. As shown in FIGS. 11 and 12, toggle clamp 76 is raised to allow the placement of blade 63 within recess 76, and then lowered to secure blade 63 in place for sharpening.

Blade 63 is sharpened in essentially the same way as blade 60, except that the user must raise or lower the grinder 49 at the appropriate time during the grinding pass, so that the grinding wheel 62 follows the complex contour and inflection 68 of cutting edge 67. The adaptability and adjustability of the apparatus 11 fitted with the adapter fixture 64, ensures that a factory-like sharpened edge can be restored to blade 63.

It should be noted that, as shown in the drawings, both blade 60 and blade 63 are designed for counter-clockwise rotation about their drive shaft or drive mechanism. However, some mower blades are designed for clockwise rotation, placing the cutting edge 55 or the cutting edge 67, on the opposite side of the blade. For the purpose of sharpening such clockwise rotation blades, a simple modification can be made to the apparatus 11, to make the position and orientation of the blade holding fixture 54 adjustable.

At the foot of post 56, a transverse plate (not shown) is welded. A pair of holes may be drilled in the plate, in spaced relation, on either side of the post. Two pairs, and preferably three, pairs of corresponding bores are drilled through upper surface 15 of frame 12. One set of the bores is selected for grinding blades designed for counter-clockwise rotation. Bolts and nuts in conjunction with the holes and bores, are used to secure the transverse plate to the frame 12.

If it is desired to sharpen blades designed for clockwise rotation, the bolts and nuts are removed, and the blade holding fixture 54 is rotated 180°. The fixture 54 is then remounted to the frame 12, through one of the other sets of bores. A particular set of bores is selected to place the post 56 and the fixture 54 in the proper spaced relation from the grinder 49. The other set of bores allows the fixture 54 to accommodate wider blades, and maintain optimum spacing between the fixture 54 and the grinder 49 during the grinding process.

What is claimed is:

1. An apparatus for sharpening blades, comprising:

a frame;

a grinder support assembly, said grinder support assembly including a support member having a lower end attached to said frame; a three-way pivot having a fixed portion mounted to an upper end of said support member; an elongated grinder support arm having a first end mounted to a movable portion of said three-way pivot; and, a grinder mount secured to a second end of said grinder support arm;

a blade holding fixture, said blade holding fixture including an inclined plate mounted on said frame, said plate including means for detachably securing a blade on said plate; and, an adapter fixture with a toggle clamp, said adapter fixture being detachably affixed to one end of said inclined plate and including an angled shelf with an alignment recess therein to orient and secure a blade at an inclination greater than that of said inclined plate.

2. An apparatus for sharpening blades, comprising:

a frame;

a grinder support assembly, said grinder support assembly including a support member having a lower end attached to said frame; a three-way pivot having a fixed portion mounted to an upper end of said support member; an elongated grinder support arm having a first end mounted to a movable portion of said three-way pivot; and, a grinder mount secured to a second end of said grinder support arm, in which a first element of said movable portion threadably engages said fixed portion and is rotatable about a first horizontal axis, said movable portion further comprising transition means having a threaded nut attached to said first element and a threaded transition shaft engaging said threaded nut, said transition shaft defining a second axis of rotation perpendicular to said first axis, said movable portion further comprising a bar member attached to a head portion of said transition shaft, said bar member including a threaded bar shaft extending from one end thereof, in which said bar shaft threadably engages a threaded nut attached to said first end of said grinder support arm, said bar shaft defining a third axis of rotation perpendicular to said second axis; and, a blade holding fixture, said blade holding fixture including an inclined plate mounted on said frame, said plate including means for detachably securing a blade on said plate.

3. The apparatus of claim 2 further including a grinder installed within said grinder mount.

4. The apparatus of claim 2 in which said plate is inclined at an angle which maintains a cutting edge of the blade in substantially parallel relation, with respect to an upper surface of said frame.

5. The apparatus of claim 2 in which said means for detachably securing the blade comprises a toggle clamp.

6. The apparatus of claim 5 further including at least one blade edge alignment stop mounted along a lower edge of said plate, and a registration pin upstanding from a central portion of said plate.

7. The apparatus of claim 2 in which said grinder support arm is extensible and retractable in length.

8. The apparatus of claim 2 in which said grinder support arm is telescopic.

9. The apparatus of claim 2 including a spring extending from said movable portion of said three-way pivot to said frame to counter-balance the weight of a grinder installed within said grinder mount.

10. The apparatus of claim 2 in which said plate is inclined approximately 30° with respect to an upper surface of said frame.

11. The apparatus of claim 2 including an adapter fixture with a toggle clamp, said adapter fixture being detachably affixed to one end of said inclined plate and including an angled shelf with an alignment recess therein to orient and secure a blade at an inclination greater than that of said inclined plate.

12. An apparatus for sharpening blades, comprising:

a frame;

a grinder support assembly, said grinder support assembly including a support member having a lower end attached to said frame;

a three-way pivot having a fixed portion mounted to an upper end of said support member and a movable portion attached to said fixed portion, said three-way pivot including a threaded shaft engaging said fixed portion, allowing rotation of said movable portion about a generally horizontal first axis, a threaded transition nut attached to said threaded shaft, said threaded nut being engaged by a threaded transition shaft allowing rotation of said movable portion about a second axis of rotation perpendicular to said first axis, and a bar member attached to said transition shaft and including a threaded shaft engaging a bar nut allowing rotation of said movable portion about a third axis of rotation perpendicular to said second axis;

an elongated grinder support arm having a first end mounted to said bar nut of said movable portion of said three-way pivot, said grinder support arm being adjustable in length;

a grinder secured to a second end of said grinder support arm; and, a blade holding fixture, said blade holding fixture including an inclined plate mounted on said frame, said plate including means for detachably securing a blade on said plate.

13. The apparatus of claim 12 in which said plate is inclined at an angle which maintains a cutting edge of the blade in substantially parallel relation, with respect to an upper surface of said frame.

14. The apparatus of claim 12 in which said means for detachably securing the blade comprises a toggle clamp.

15. The apparatus of claim 12 in which said inclined plate includes a registration pin extending upwardly from a blade supporting surface, and in which at least one upwardly extending edge alignment stop is located along a lower edge of said plate.

16. The apparatus of claim 12 including bias means extending from said movable portion of said three-way pivot to said frame, providing an upward bias on said second end of said grinder support arm.

17. The apparatus of claim 16 in which said bias means comprises a spring.

18. The apparatus of claim 12 in which said three-way pivot can selectively be locked in a rotational position about each of said first, second, and third axes.

19. An apparatus for sharpening blades, comprising:

a frame;

a grinder support assembly, said grinder support assembly including a support member having a lower end attached to said frame;

a three-way pivot having a fixed portion mounted to an upper end of said support member and a movable portion attached to said fixed portion, said three-way pivot allowing rotation of said movable portion about a generally horizontal first axis, rotation of said movable portion about a second axis perpendicular to said first axis, and rotation of said movable portion about a third axis perpendicular to said second axis;

an elongated grinder support arm having a first end mounted to said movable portion of said three-way pivot, said grinder support arm being adjustable in length;

a grinder secured to a second end of said grinder support arm;

bias means extending from said movable portion of said three-way pivot to said frame, providing an upward bias on said second end of said grinder support arm; and, a blade holding fixture, said blade holding fixture including an inclined plate mounted on said frame, said plate including means for detachably securing a blade on said plate.

20. The apparatus of claim 19 in which said bias means comprises a spring.

* * * * *